US007129810B1

(12) United States Patent
Kimura

(10) Patent No.: US 7,129,810 B1
(45) Date of Patent: Oct. 31, 2006

(54) COMMON MODE CHOKE COIL

(75) Inventor: Satoshi Kimura, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 09/547,496

(22) Filed: Apr. 12, 2000

(30) Foreign Application Priority Data

Apr. 13, 1999 (JP) ..... 11-105526

(51) Int. Cl.
*H01F 27/02* (2006.01)

(52) U.S. Cl. ..... 336/83; 336/200

(58) Field of Classification Search ..... 336/83, 336/200, 178, 192, 198, 232–233, 65
See application file for complete search history.

(56) References Cited

U.S. PATENT DOCUMENTS 4,352,080 A * 9/1982 Mitsui et al. ..... 336/83
5,680,087 A * 10/1997 Sakata et al. ..... 336/83
6,157,283 A * 12/2000 Tsunemi ..... 336/192

* cited by examiner

*Primary Examiner*—Tuyen T Nguyen
(74) *Attorney, Agent, or Firm*—Katten Muchin Rosenman LLP

(57) ABSTRACT

A common mode choke coil has a ferrite core provided with a pair of first lateral walls opposite to each other, a pair of second lateral walls opposite to each other, a pair of through holes formed through the pair of first lateral walls, a cover having a substantial H-shape to thereby provide an opened region opened upwardly by cooperating with the pair of through holes, a bottom having a substantial rectangular shape, a bobbin extending vertically across the pair of through holes and electrodes extending from the bottom to the cover, being on an external surface of the common mode choke coil. Windings are electrically connected to the electrodes, respectively.

4 Claims, 8 Drawing Sheets

COMMON MODE CHOKE COIL

FIELD OF THE INVENTION

The present invention relates to a common mode choke coil; and, more particularly, to a chip type common mode choke coil wherein a plurality of electrodes are vertically mounted on a ferrite core.

DESCRIPTION OF THE PRIOR ART

A common mode choke coil is a coil component used to reduce or remove a noise occurred in a common mode of electronic appliances such as a television, a VCR(video cassette recorder), a computer system and peripherals thereof, a measuring device and a control device.

The applicant proposed a chip type common mode choke coil 30 as shown in FIG. 5 in Japanese Patent Laid-Open Publication No. Heisei 8-306559, which is simple to manufacture, easy to miniaturize and capable of being mounted on a printed circuit board.

As shown, a core 21 has a box-like shape which has main opposite walls 24, an upper and a lower walls 23 and openings 28 formed through the opposite side walls. A bobbin 25 is formed inside of the core 21, between the openings 28. Four electrodes 22 are formed on lateral ends of the core 21 adjacent to the openings 28. Winding 29 is wound around the bobbin 25. Ends 26 of the winding 29 are electrically connected to the electrodes 22 through the openings 28 by soldering 27. An insulating material(not shown) is charged inside the core 21.

The common mode choke coil 30 described above has advantages in that it has a small number of components and a configuration for allowing a simple assembling of the components.

The core 21 employed in the common mode choke coil 30 having the electrodes vertically attached thereon is made of a magnetic material such as Ni and Zn-based ferrite or a Mn and Zn-based ferrite, all of which have a high resistance. For example, electrodes 22 of the type having a conductive cover film layer constructed in such a manner that a solder plate layer is made on, e.g., a silver paste, can be vertically attached on the core.

However, the common mode choke coil described in reference to FIG. 5 has the following shortcomings:

It has a lower workability, since the winding is wound around the bobbin 25 manually. That is, the openings are not large enough to accommodate an automatic winding process therethrough. Further, if a pair winding is used as the winding, it is difficult to divide the pair winding into two pieces and connect them to the corresponding electrodes, respectively. Further, it is difficult to remove a burr which remains around the bobbin 25 after the core is shaped by molding process. The burr must be removed to prevent a coat of the winding from being torn thereby. Furthermore, it is difficult to charge an insulating material(normally synthetic resin) into the inside of the core 21, since the openings 28 are too small. Finally, the soldering process which connects the ends of the winding to the electrodes may damage the winding.

The shortcomings described above may lead to a reduction of the number of products having an acceptable quality.

SUMMARY OF THE INVENTION

It is, therefore, a primary object of the invention to provide a common mode choke coil having a core and an electrode connection capable of solving the above described shortcomings and increasing the number of the products having an acceptable quality.

The above and other objects of the invention are accomplished by providing a common mode choke coil having a ferrite core provided with a pair of first lateral walls opposite to each other, a pair of second lateral walls opposite to each other, a pair of through holes formed through the pair of first lateral walls, a cover having a substantial H-shape to thereby provide an opened region opened upwardly by cooperating with the pair of through holes, a bottom having a substantial rectangular shape, a bobbin extending vertically across the pair of through holes and electrodes extending from the bottom to the cover, being on an external surface of the common mode choke coil. Windings are electrically connected to the electrodes, respectively.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Figure 1:
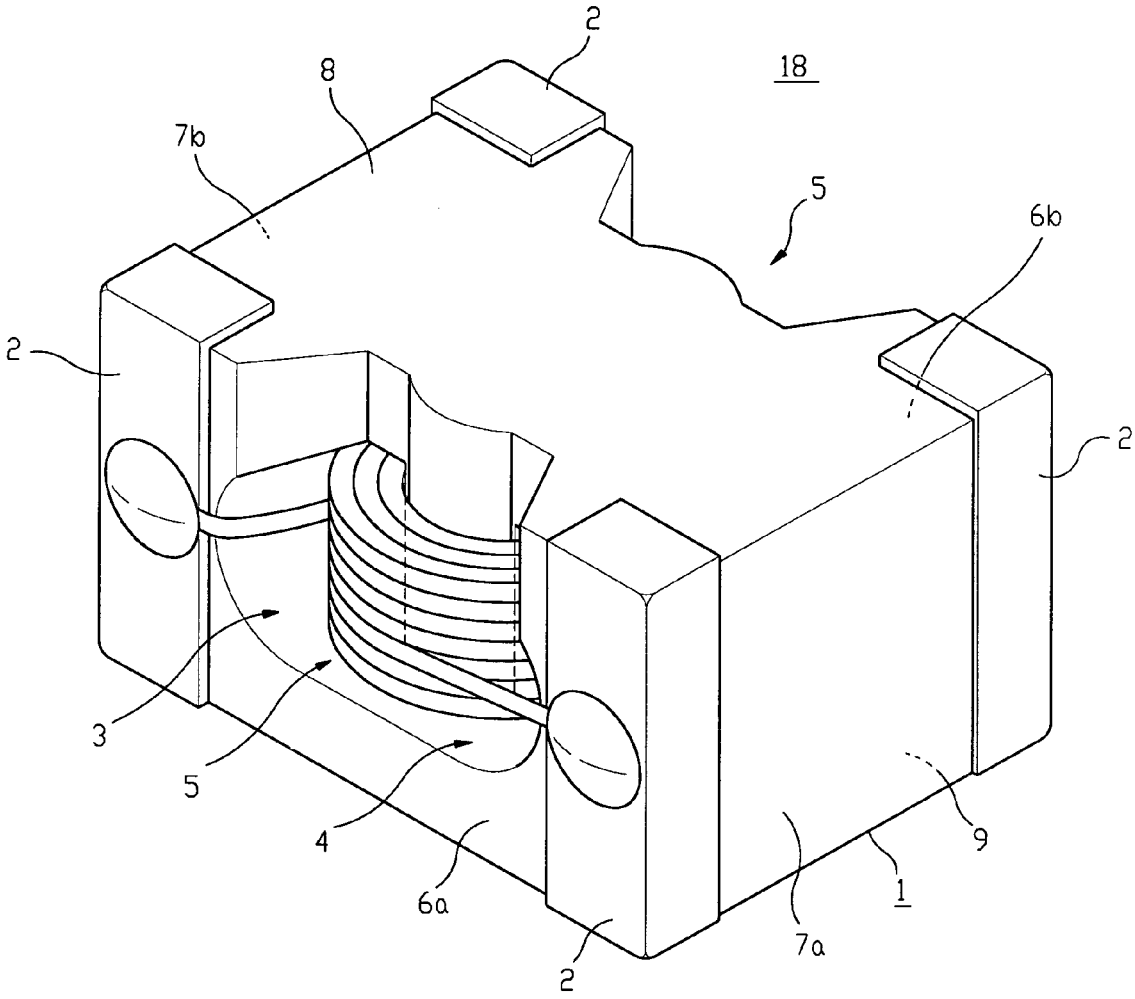
FIG. 1 shows a perspective view of a ferrite core and an electrode vertically attached on the ferrite core in accordance with one embodiment of the inventive common mode choke coil.
Figure 2A:
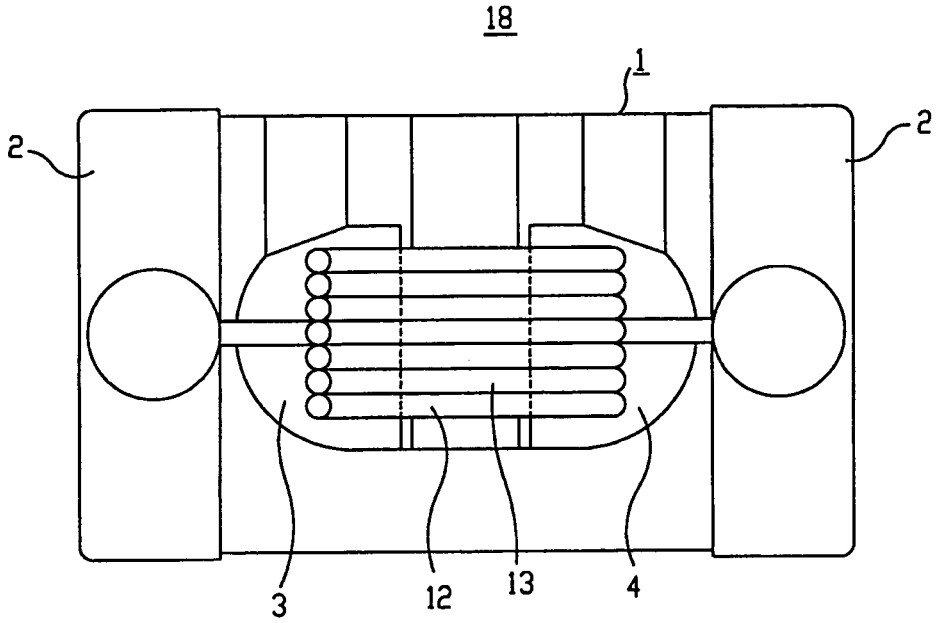
FIGS. 2A, 2B and 2D present a front view, a top planar view and a bottom view of the common mode choke coil shown in FIG. 1, respectively.
Figure 2B:
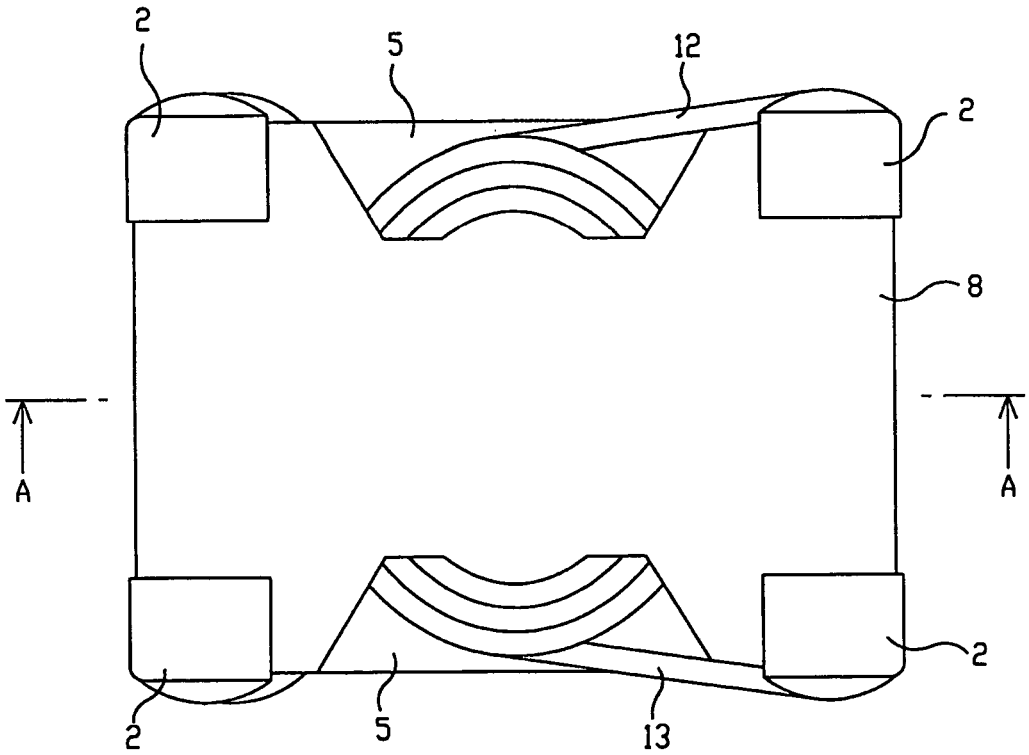
Figure 2C:
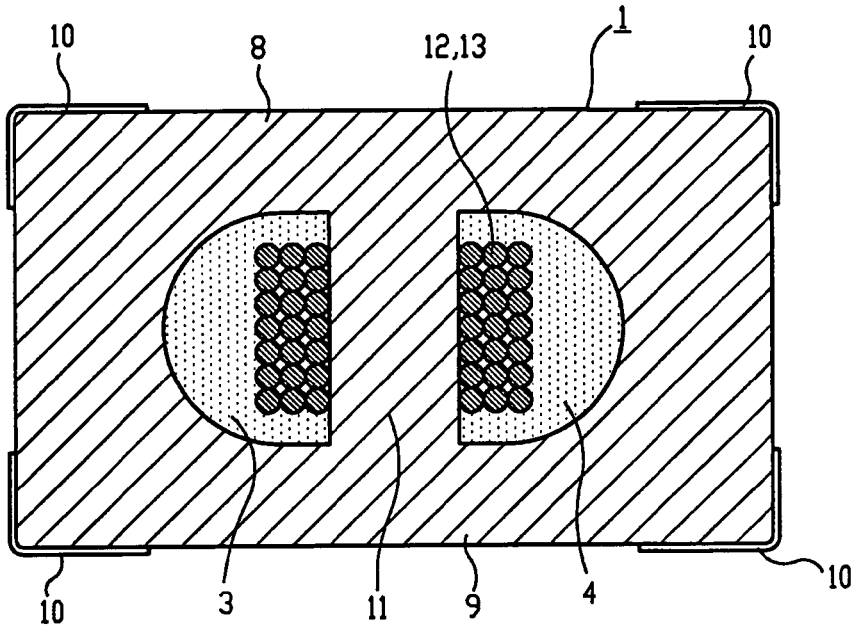
FIG. 2C represents a sectional view taken along a line A—A in FIG. 2B.
Figure 2D:
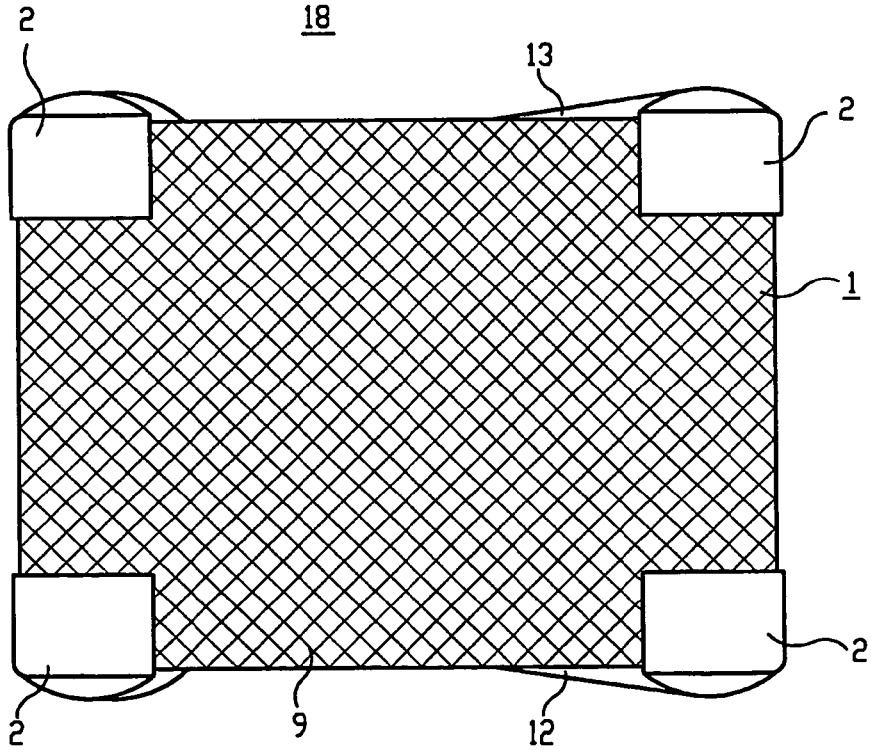
Figure 3A:
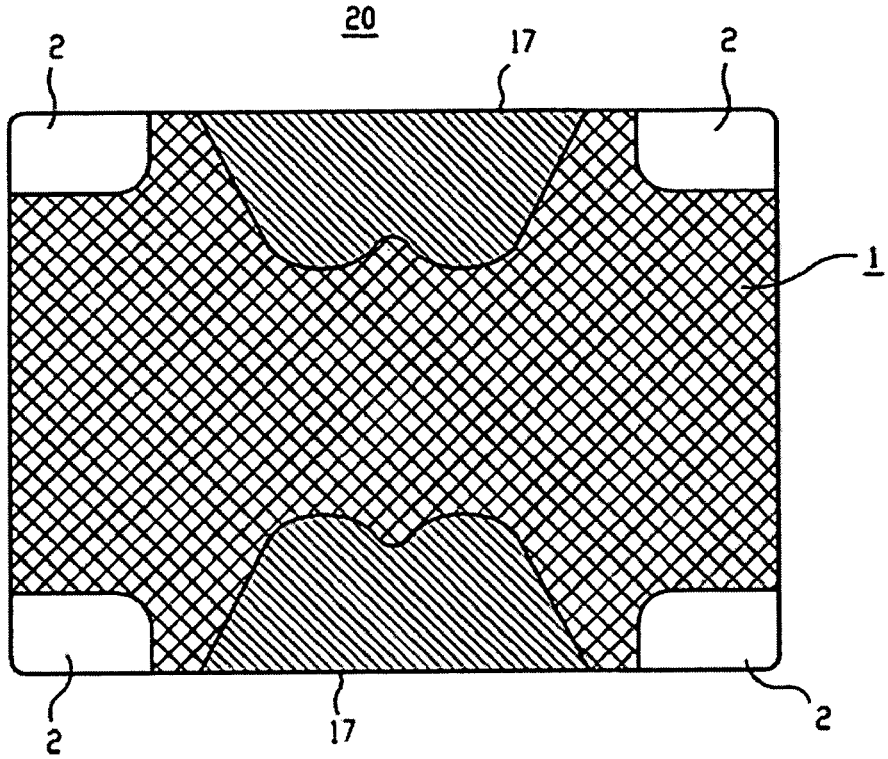
FIGS. 3A, 3B, 3C and 3D offer a top planar view, a front view, a side elevational view and a bottom view of a common mode choke coil in accordance with another embodiment of the present invention, respectively.
Figure 3B:
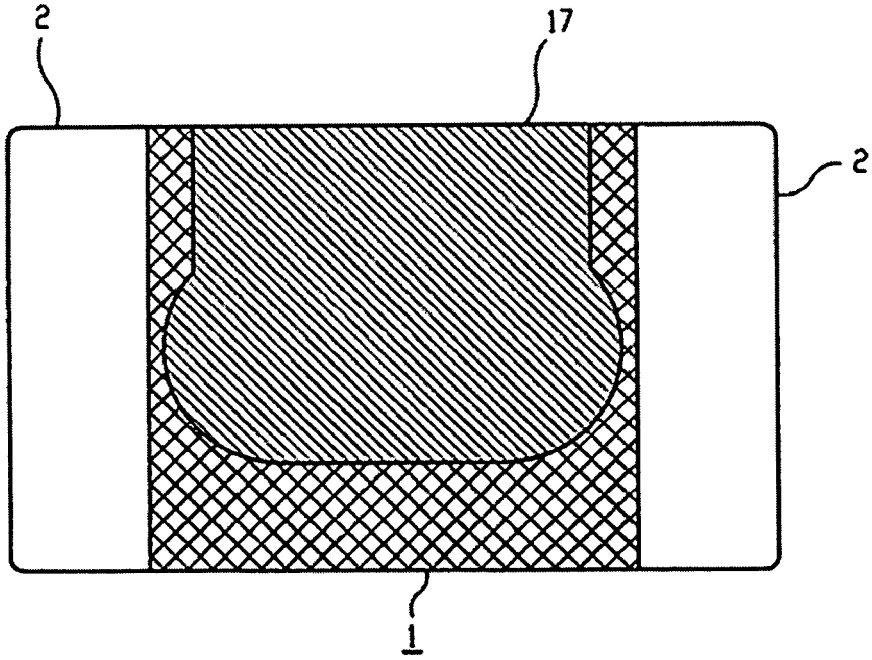
Figure 3C:
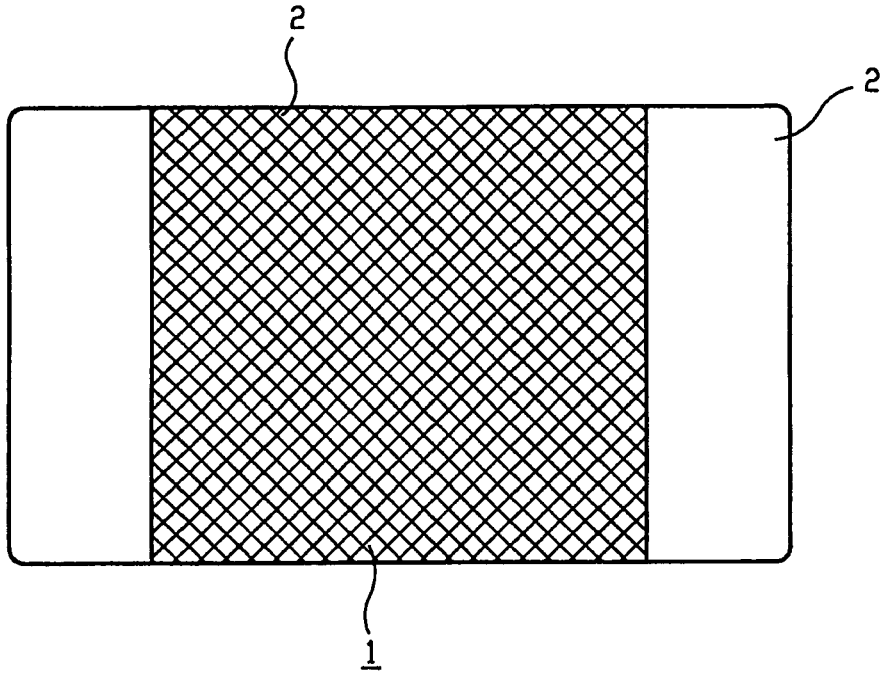
Figure 3D:
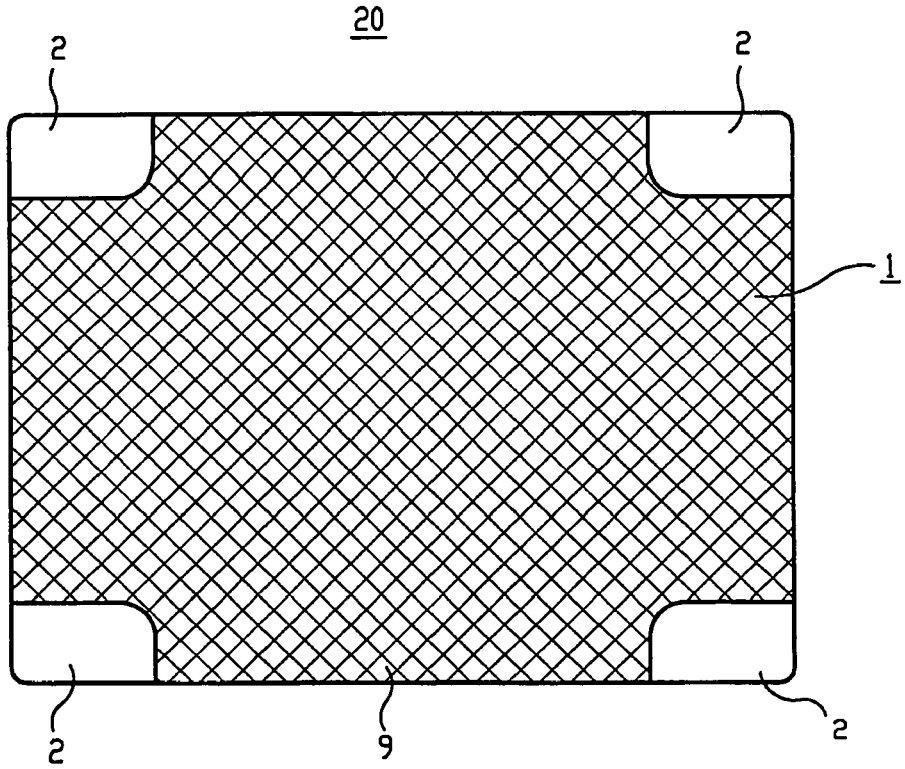
Figure 4A:
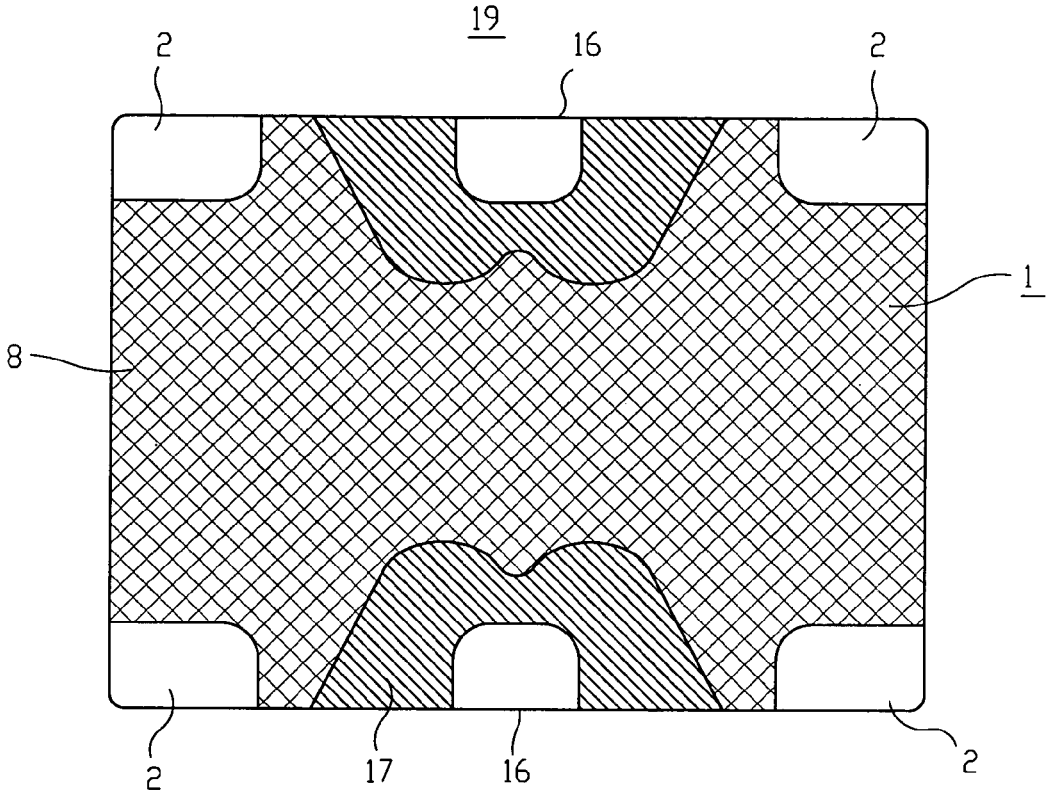
FIGS. 4A through 4D represent a top planar view, a front view, a side elevational view and a bottom view of a three line type common mode choke coil in accordance with the present invention.
Figure 4B:
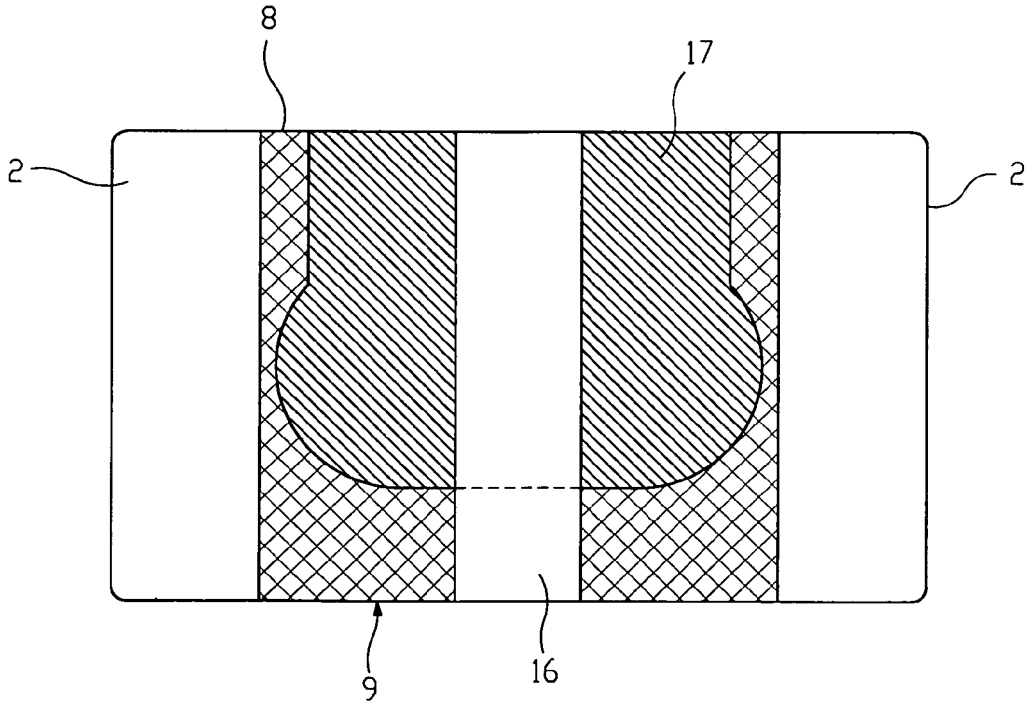
Figure 4C:
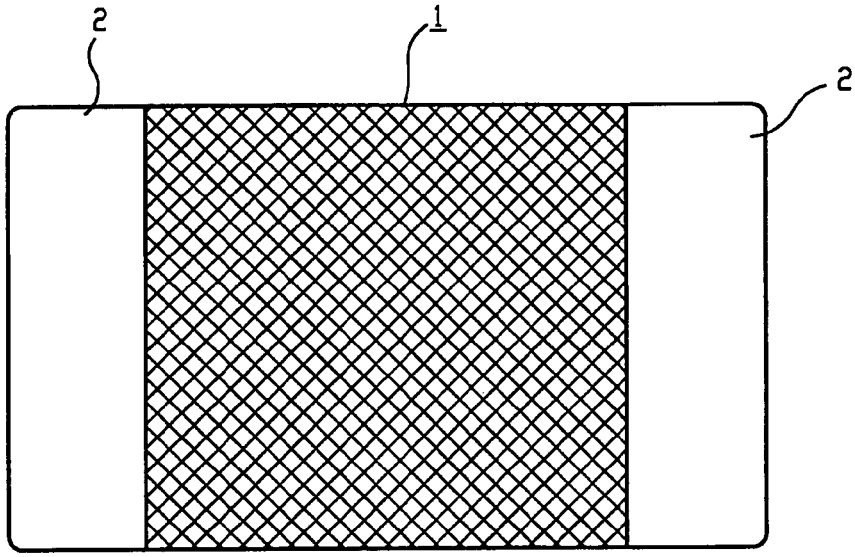
Figure 4D:
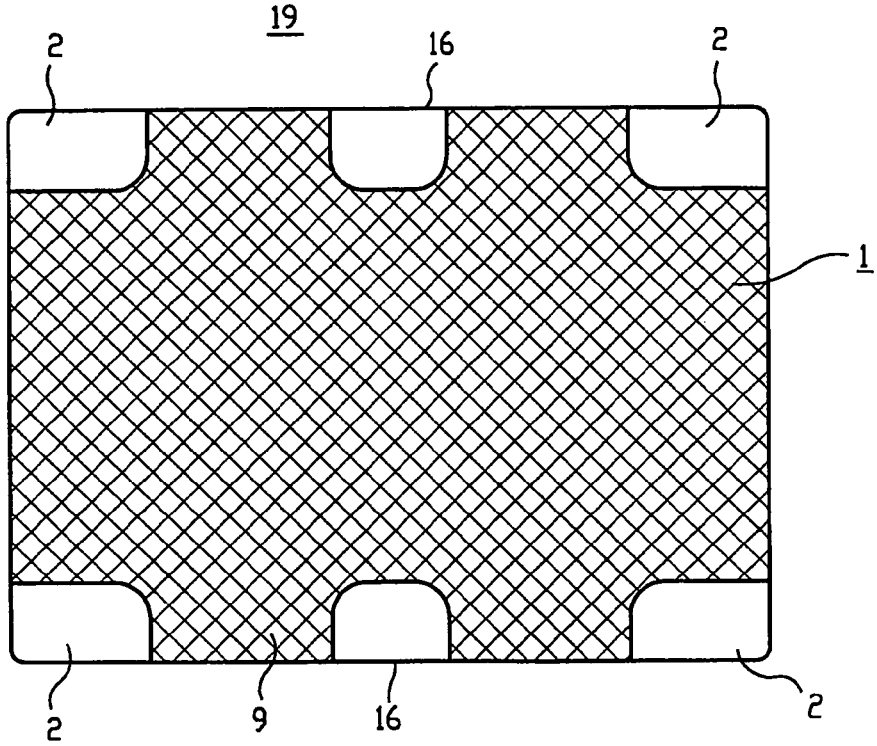
Figure 5:
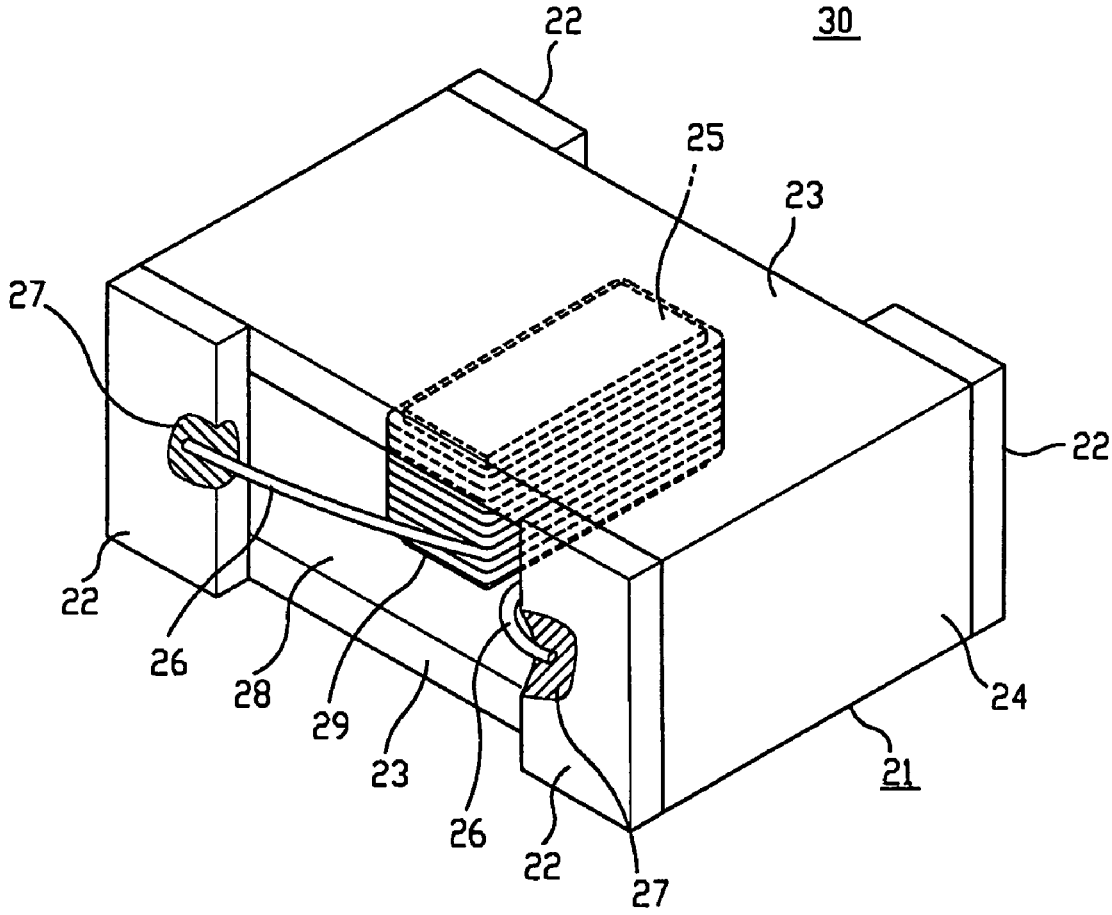
FIG. 5 (PRIOR ART)
FIG. 5 offers a perspective view of a prior art common mode choke coil.

FIG. 1 shows a perspective view of a ferrite core 1 and an electrode 2 vertically attached on the ferrite core 1 in accordance with one embodiment of the inventive common mode choke coil. FIGS. 2A and 2B present a front view and a top planar view of the common mode choke coil shown in FIG. 1, respectively. FIG. 2C represents a sectional view taken along a line A—A in FIG. 2B. FIGS. 3A, 3B and 3C offer a top planar view, a front view and a side elevational view of a common mode choke coil in accordance with another embodiment of the present invention, respectively.

As shown in FIGS. 1 and 2, an inventive common mode choke coil 18 includes a ferrite core 1 of a substantial cubic-shape made of a ferrite core material as one piece. The ferrite core 1 includes a cover 8 contoured as H-shape allowing a bobbin 11 to be exposed to the outside, when viewed from a top of the cover 8; a bottom 9 having a substantial rectangular shape; a front and a rear wall 6*a* and 6*b*; and a pair of side walls 7*a* and 7*b*. A pair of semicircular through holes 3 and 4 are formed in a parallel relationship with each other through the front and the rear wall 6*a* and 6*b*. The cover 8, the bottom 9, the front and the rear wall 6*a* and 6*b*, and the side walls 7*a* and 7*b* together form a substantial cubic-shape. The H-shape of the cover 8 makes an opened region 5 near the semicircular through holes 3 and 4 to be upwardly opened.

The inventive common mode choke coil 18 also includes four electrodes 2, each of which extends from a bottom 9 to the cover 8 at one of four corners defined with four lateral walls 6*a*, 6*b*, 7*a*, 7*b*. In the present invention, a pair of windings 12 and 13 are wound around the bobbin 11 partitioning the semicircular through holes 3 and 4, with ends 14 of the windings 12 and 13 being electrically connected to the electrodes 2, respectively.

In this construction, since the bobbin 11 is exposed to the outside, a burr around the bobbin 11 can be easily removed by using, e.g., a barrel machining.

Further, since the cover 8 contoured as the H-shape generates the opened region 5 which is upwardly opened, a winding operation of the pair of windings 12 and 13 around the bobbin 11, a dividing operation of the ends of the windings, and an electrical connection between the ends of the windings and the electrodes can easily be carried out; and an automation of those operations can be easily achieved.

Next, a common mode choke coil 20 shown in FIGS. 3A through 3D wherein a sealant 17 such as an epoxy is charged through the pair of semicircular through-holes 3 and 4 and near the cover 8 contoured as H-shape, allowing the ferrite core 1 to have a complete cubic shape with an identical appearance from an upside and a downside thereof, allowing it to be easily mounted on, e.g., a circuit board as a chip type electronic component. Further, since the electrodes 2 extend from the cover 8 to the bottom 9, to appear substantially identical at the upside and downside of the ferrite core 1, an automatic mounting can be easily applied in mounting the common mode choke coil, without necessitating a consideration on the distinction between the upside and downside of the common mode choke coil 20.

In a charging process of the sealant 17, it is important for the sealant 17 to be easily charged into the ferrite core 1 and the charged sealant 17 must be maintained therein. Even at those points, the opened region 5 of the inventive ferrite core 1, which is widely opened upwardly(or downwardly) can effect a facility of the charging process and a best maintenance of a shape of the charged sealant 17.

That is, the normal charging process of the sealant 17 of an epoxy-based resin is usually performed in such a manner that after the windings 12 and 13 are wound around the bobbin 11 and then electrically connected to the electrodes 2, the sealant 17 is charged through a vacant space of the semicircular through holes 3 and 4 and a cut out portion defined by the H-shape of the cover 8. During this process, since the ferrite core 1 of the present invention has the opened region widened 5 at ends of the both semicircular through holes 3 and 4 by the cut out portion, the sealant 17 directly reaches the bobbin 11 to be smoothly charged into a deep inside of the semicircular through holes 3 and 4.

Further, since the bottom 9 has a substantially rectangular shape and the charged sealant 17 is received and maintained thereon, it is difficult for the seated sealant 17 to deviate from a desired position. That is, it is easy for the charged and seated sealant 17 to maintain its shape.

Further, the windings 12 and 13 may be prevented from being damaged by the sealant 17 when the sealant 17 is introduced into the semicircular through holes 3 and 4, since a pressure exerted by the sealant 17 being introduced is not high, as a result of the sealant being easily introduced. In other words, the ferrite core 1 has a construction wherein the sealant 17 can be easily introduced into the ferrite core 1 without being easily deviated from the cured shape.

For example, if both of the bottom 9 and the cover 8 have the H-shape, it is difficult for the charged sealant 17 to maintain its shape and to be evenly charged into the inside of the ferrite core 1.

Consequently, in case that only the cover 8 or the bottom 9 has the H-shape as the common mode choke coils 18 and 20 in accordance with the embodiments of the present invention, an increase of the workability in removing the burr around the bobbin 11, winding the windings 12 and 13 around the bobbin 11 and charging the sealant 17 can be obtained.

Next, in the common mode choke coils 18 and 20, each of the ends of the windings 12 and 13 wounded around the bobbin 11 is electrically connected to one of the four electrodes 2 by thermo-compression bonding. The electrodes 2 have a configuration, e.g., of two layers, wherein a silver paste layer is plated with a conductive solder layer or a conductive tin layer.

Since the thermo-compression bonding is performed in a very short time by pressing the ends of the windings 12 and 13 against the electrodes 2, a heat transfer to the wounded portion is more difficult to achieve than that in the prior art soldering method. Accordingly, the windings having a covering may be less damaged.

Although the common mode choke coils 18 and 20 described so far are two line type having two circuits, the common mode choke in accordance with the present invention is applicable to a type having three or more circuits. Hereinafter, three line type common mode choke coil will be described.

FIGS. 4A through 4D represent a top planar view, a frontal view, a side elevational view and a bottom view of the three line type common mode choke coil in accordance with the present invention.

The common mode choke coil 19 shown in FIG. 4 includes a ferrite core 1 through which a pair of semicircular through holes are formed, as similar to the common mode choke coil 18. The ferrite core 1 includes a cover 8 contoured as H-shape, when viewed from a top thereof. The H-shape of the cover 8 makes an opened region near the semicircular through holes upwardly opened.

The common mode choke coil 19 includes two electrodes 16 together with the four electrodes 2 which are similar to the common mode choke coil 18. The electrodes 16 are vertically attached on the ferrite core 1. In the common mode choke coil 19, three windings are wound around the bobbin 11, with ends of the windings being electrically connected to the electrodes 2 and 16, respectively.

The sealant 17 is charged through the pair of semicircular through-holes and near the cut out portion of the cover 8 contoured as H-shape, to allow the ferrite core 1 to have a complete cubic shape with an identical appearance from an upside and a downside thereof, as similar to the common mode choke coil 20.

In this embodiment, the electrodes 16 are formed at the bottom 9 to extend vertically along an external surface of the sealant 17 and terminate at the cover 8, while being electrically connected to the winding.

As described above, the chip type common mode choke coil 18, 19 and 20 in accordance with the present invention have an increased workability in removing the burr around the bobbin, winding the windings around the bobbin and charging the sealant. They can be easily manufactured and can be easily mounted on, e.g., a circuit board.

Further, the inventive common mode choke coil has following advantages:

(a) Since one of the cover and the bottom is cut out, it is easy to remove the burr around the bobbin, to divide end of the pair winding and to electrically connect the winding;

(b) The complete cubic shape obtained after the sealant is charged simplifies the mounting of the common mode choke coil as a chip type electronic component;

(c) Since one of the bottom or the cover is not cut out to support the charged sealant, it is difficult for the seated sealant to deviate from a desired position and to damage the wound windings when the sealant is introduced into the ferrite core;

(d) Since the thermo-compression bonding can reduce the damage of the windings by preventing the heat from being transferred; and (e) A good productivity can be obtained in the manufacturing of the common mode choke coil.

Although the invention has been shown and described with respect to the preferred embodiments, it will be understood by those skilled in the art that various changes and modifications may be made without departing from the spirit and scope of the invention as defined in the following claims.

What is claimed is:

1. A common mode choke coil comprising:

a ferrite core formed of one piece including: a front and a rear wall opposite to each other;

a pair of side walls opposite to each other;

a pair of through holes formed through the the first and the rear wall;

a cover having a substantial H-shape to thereby provide an opened region opened upwardly by cooperating with the pair of through holes;

a bottom having a substantially rectangular shape; and a bobbin extending vertically between the cover and the bottom across the pair of through holes;

electrodes extending from the bottom to the cover at corners defined with the front wall, the rear wall and the side walls, respectively; and windings wound around the bobbin, ends of the windings being electrically connected to the electrodes, respectively, wherein the cover, the bottom, the front and the rear wall, and the side walls together form a substantial cubic-shape and the bobbin is exposed upwardly through the opened region to the outside.

2. The common mode choke coil of claim 1, wherein a sealant is charged in the through holes and the opened region of the H-shaped cover and received and maintained on the rectangular bottom to make the ferrite core have a complete cubic shape.

3. The common mode choke coil of claim 1, wherein said windings are electrically connected to the electrodes, respectively, by thermo-compression bonding.

4. The common mode choke coil of claim 2, wherein said windings are electrically connected to the electrodes, respectively, by thermo-compression bonding.

* * * * *